US012765733B2

(12) United States Patent
Zhang

(10) Patent No.: US 12,765,733 B2
(45) Date of Patent: Oct. 20, 2026

(54) FILTER ASSEMBLY, VACUUM CLEANER AND CLEANING SET

(71) Applicant: SUZHOU SONGMU TECHNOLOGY CO., LTD., Suzhou (CN)

(72) Inventor: Dan Zhang, Suzhou (CN)

(73) Assignee: SUZHOU SONGMU TECHNOLOGY CO., LTD, Suzhou (CN)

( * ) Notice: Subject to any disclaimer, the term of this patent is extended or adjusted under 35 U.S.C. 154(b) by 411 days.

(21) Appl. No.: 18/619,234

(22) Filed: Mar. 28, 2024

(65) Prior Publication Data

US 2024/0398190 A1 Dec. 5, 2024

Related U.S. Application Data

(63) Continuation-in-part of application No. PCT/CN2023/106104, filed on Jul. 6, 2023.

(30) Foreign Application Priority Data

Jun. 2, 2023 (CN) ..... 202310647635.X

(51) Int. Cl.
*A47L 9/16* (2006.01)
*A47L 9/20* (2006.01)

(52) U.S. Cl.
CPC ..... *A47L 9/1666* (2013.01); *A47L 9/20* (2013.01)

(58) Field of Classification Search
CPC . A47L 9/1666; A47L 9/20; A47L 5/14; A47L 9/127
See application file for complete search history.

(56) References Cited

U.S. PATENT DOCUMENTS

2010/0139033 A1 6/2010 Makarov et al.
2018/0289227 A1* 10/2018 Takano ..... A47L 5/24

FOREIGN PATENT DOCUMENTS

| | | | |
|---|---|---|---|
| CN | 203861142 | U | 10/2014 |
| CN | 207220759 | U | 4/2018 |
| CN | 108095637 | A | 6/2018 |
| CN | 109247873 | A | 1/2019 |
| CN | 112401742 | A | 2/2021 |
| CN | 218651617 | U | 3/2023 |
| CN | 116019386 | A | 4/2023 |
| CN | 116473457 | A | 7/2023 |
| KR | 20080017166 | A | 2/2008 |

* cited by examiner

*Primary Examiner* — Andrew A Horton

(57) ABSTRACT

A filter assembly, a vacuum cleaner and a cleaning set are provided. The filter assembly comprises a cyclone separator and a high efficiency particulate air filter (HEPA) assembly; the cyclone separator comprises a filter support and a filter screen, an air guide structure which protrudes outwards in a radial direction and spirally extends towards one side of the filter screen is formed on a side wall of one end of the filter support, and a plurality of through first air outlet holes are formed in the air guide structure; and the HEPA assembly comprises an HEPA support and an HEPA body, a plurality of second air outlet holes are formed in the HEPA support, the HEPA body is arranged on the HEPA support and comprises a plurality of folds, and an airflow circulation channel in an axis direction of the cyclone separator is formed between any two adjacent folds.

10 Claims, 6 Drawing Sheets

FILTER ASSEMBLY, VACUUM CLEANER AND CLEANING SET

CROSS REFERENCE TO THE RELATED APPLICATIONS

This application is the Continuation-in-part Application of International Application No. PCT/CN2023/106104, filed on Jul. 6, 2023, which is based upon and claims priority to Chinese Patent Application No. 202310647635.X, filed on Jun. 2, 2023, the entire contents of which are incorporated herein by reference.

TECHNICAL FIELD

The present invention relates to the technical field of cleaning devices, and in particular, to a filter assembly, a vacuum cleaner, and a cleaning set.

BACKGROUND

Hand-held vacuum cleaners are increasingly moved into thousands of households due to their advantages of small size, portability and the fact of being not constrained by power cords. A hand-held vacuum cleaner generally sucks garbage and other impurities into a dust bucket through a negative pressure generated by a fan, and a dust cup has a small volume. After use, the dust bucket is opened to dump the garbage, but the dust will be scattered when it is poured, causing secondary pollution. In order to solve the above problems, a base station with dust collection function has appeared in the market, which can collect the dust in the dust cup to avoid the dust from rising. For example, Chinese patent No. CN218651617U discloses a dust collection system of a vacuum cleaner base station, which comprises a base station and a vacuum cleaner. The base station comprises a base, a supporting rod and a supporting part. A collected dust accommodating cavity is arranged in the supporting part, and a dust collection bag and a negative pressure assembly are arranged in the base. The vacuum cleaner comprises a hand-held rod and a dust collection cup. The dust collection cup is provided with a dust cup body and a dust cup bottom cover, a release button for controlling the dust cup bottom cover to rotate to open or close is arranged on the dust cup body. The vacuum cleaner is placed on the base station, a trigger part on the base station triggers the release button of the bottom cover, the dust cup bottom cover is opened, the negative pressure assembly sucks to generate a negative pressure in the accommodating cavity, and the dust inside the dust cup body automatically falls and is collected in the base station, thus achieving the purpose of self-dust collection. According to the cleaning device with such conventional solution, the whole cleaning set is provided with two suction devices, one suction device is arranged in the vacuum cleaner and used for enabling the vacuum cleaner to generate a negative pressure in the dust cup in a dust suction state so as to achieve a purpose of dust suction, and the other suction device is used for enabling the dust collection cavity of the base station to generate a negative pressure so as to achieve a purpose of collecting dust in the dust cup when collecting dust. On one hand, the cost is high; on the other hand, because an airflow passes through a long suction channel at a front end during suction, an air volume loss is large, resulting in small integrated effective air volume and poor dust collection effect; on the other hand, a weight of the whole cleaning set is heavy, which is not conducive for a customer to carry and move. In addition, the dust cup of the vacuum cleaner is usually provided with a filtering and separating assembly for separating dust particles, such as a conventional cyclone filter, which is a core part of the vacuum cleaner. After frequent use of the filtering and separating assembly, a lot of dust and sundries will accumulate on a filter element, which results in poor filtering effect, and needs to clean the filter element to improve a filtering effect thereof, and cleaning has always been a big problem that puzzles consumers. According to the prior art, the filter assembly is usually dismounted, and then washed and purged manually, but this way of cleaning process is cumbersome and inefficient, and in the process of hand washing, dust is easy to enter a human respiratory system during cleaning as the dust is close to people, so the current market demand cannot be met. In order to solve this problem, there are various filter self-cleaning structures in the market, which may be roughly divided into contact cleaning structures and non-contact cleaning structures. The contact cleaning structures comprise ash scraping strips, brush strips, scrapers, and the like, which directly act on a filter screen of the filter, while the non-contact cleaning structures comprise knocking vibration or negative pressure suction. The contact cleaning generally works at the same time when the vacuum cleaner is started. A user cannot choose a self-cleaning time according to the needs thereof, and working noise is loud, which affects the experience, and the cleaning effect is not good. For hard cleaning parts such as the scraper, it is easy to damage the filter screen during cleaning, which will affect a filtering effect of the filter screen and even make the filter screen be disabled. Non-contact solutions are widely used in existing vacuum cleaners, such as a filter self-cleaning device and a vacuum cleaner disclosed in Chinese Patent No. CN116019386A. The filter self-cleaning device comprises a casing, a power source, a transmission assembly, a cam, a striking piece and an elastic piece. The striking piece comprises a contacting part and a striking part, the contact part is in contact with the cam, and the striking part is used for striking a striking object connected with a filter. By striking the striking piece, the filter vibrates and dust is separated from a filter screen, thus achieving a purpose of cleaning the filter. However, in this solution, on one hand, a structure of the filter self-cleaning device is very complicated, resulting in high design cost; on the other hand, the striking piece can only clean the filter screen of the filter, but cannot clean the dust attached to an inner wall of a dust cup. In the negative pressure suction solution, on one hand, it is also necessary to increase a suction device, resulting in higher cost. On the other hand, as a suction airflow needs to pass through a long suction channel at the front end, an air volume loss is large, and an air volume actually entering the dust cup to reverse wash the filter screen of the filter is small, so the self-cleaning effect of the filter is not good. Moreover, most of the existing filter assembly structures adopt cyclone filter structure, but the existing cyclone filter structure is only used to realize gas-solid separation in a dust suction state, and has relatively simple functions, so it is necessary to further improve the existing cyclone filter structure to strengthen the functions thereof. Therefore, the present invention has been made in order to solve the above problems.

SUMMARY

With respect to at least one of the technical problems mentioned above, an object of the present invention is to provide a filter assembly, a vacuum cleaner and a cleaning set.

A technical solution of the disclosure is as follows:

One object of the present invention is to provide a filter assembly, comprising a cyclone separator for primary filtration and a high efficiency particulate air filter (HEPA) assembly for secondary filtration arranged in the cyclone separator; wherein, the cyclone separator comprises a filter support and a filter screen arranged on the filter support, an air guide structure which protrudes outwards in a radial direction and spirally extends towards one side of the filter screen is formed on a side wall of one end of the filter support, and a plurality of through first air outlet holes are formed in the air guide structure;

the HEPA assembly comprises an HEPA support and an HEPA body, the HEPA support is suitable for being fixed at one end of the filter support provided with the first air outlet holes and a plurality of second air outlet holes are formed in the HEPA support, the HEPA body is arranged on the HEPA support and comprises a plurality of folds, and an airflow circulation channel in an axis direction of the cyclone separator is formed between any two adjacent folds; and the filter assembly has a dust suction state and a dust blowing state when being used in a vacuum cleaner, in the dust suction state, the other end of the filter support is closed, and an airflow forms a spiral airflow along an outer contour of the air guide structure, enters the filter support after primary filtration through the filter screen, and is discharged from a top opening of the HEPA body along the airflow circulation channel after secondary filtration by the HEPA assembly; and in the dust blowing state, the airflow enters the filter support from the second air outlet holes and partly blows into a space between an outer wall of the filter screen and an inner wall of a dust cup body of the vacuum cleaner through the first air outlet holes, while partly blows into a space between an inner wall of the filter support and an outer wall of the HEPA body, thus realizing self-cleaning of the cyclone separator, the HEPA assembly and the dust cup.

In the embodiments of the present invention, a projection of the air guide structure on a horizontal plane is a circular ring, and included angles formed between extending directions of at least a part of the first air outlet holes and a line connecting a center of the circular ring and any ends of the first air outlet holes are non-zero.

In the embodiments of the present invention, the included angles formed between the extending directions of all the first air outlet holes on a horizontal plane of projection and the line connecting the center of the circular ring and any ends of the first air outlet holes are equal.

In the embodiments of the present invention, a wall surface of the HEPA support provided with the second air outlet holes is a circular plane, and the second air outlet holes comprise two circles of air outlet holes with a center of the circular plane as a circle center and distributed at intervals in the radial direction, the second air outlet holes of the inner ring are overlapped with a projection of a space between an inner wall of the cyclone separator and the outer wall of the HEPA body on a horizontal plane, and the second air outlet holes of the outer ring are overlapped with projections of the first air outlet holes on the horizontal plane.

In the embodiments of the present invention, the HEPA assembly further comprises an HEPA bottom cover, the HEPA bottom cover is arranged at one end of the HEPA body far away from the HEPA support, and the HEPA bottom cover is provided with an avoidance notch corresponding to any airflow circulation channel.

In the embodiments of the present invention, the HEPA body is columnar or flaky.

In the embodiments of the present invention, the other end of the filter support is in an inverted cone shape and extends to contact with a movable cover plate on a bottom cover of the dust cup of the vacuum cleaner or is internally provided with an air-blowing dust-shielding structure capable of being closed in the dust suction state and opened in the dust blowing state.

In the embodiments of the present invention, the air-blowing dust-shielding structure is a dust-proof sheet made of a soft material or is a one-way valve.

Another object of the present invention is to provide a vacuum cleaner, comprising a brush head assembly, a body assembly, a fan assembly and a dust cup assembly, wherein the brush head assembly is connected with an air inlet channel on the body assembly through an extension pipe, the fan assembly and the dust cup assembly are mounted on the body assembly, the dust cup assembly comprises a dust cup body and a filter assembly arranged in the dust cup body, and the filter assembly is any one of the filter assemblies mentioned above.

A further object of the present invention is to provide a cleaning kit, comprising a vacuum cleaner and a base station, wherein the vacuum cleaner is the vacuum cleaner mentioned above, and/or, a power source of the base station in a dust collection state and a power source of the vacuum cleaner in a dust suction state are both the fan assembly in the vacuum cleaner, and the fan assembly blows forward to the dust cup assembly and the base station in the dust collection state.

Compared with the prior art, the present invention has the advantages that:

According to the filter assembly of the present invention, by arranging the plurality of spiral air guide structure and forming the spiral first air outlet holes in the air guide structure, gas-solid separation in the dust suction state is realized, and self-cleaning of an interior and an exterior of the filter assembly and the inner wall of the dust cup during self-dust collection is realized. The structure is simple, and a self-cleaning dust-discharging effect is good.

BRIEF DESCRIPTION OF THE DRAWINGS

The present invention will be further described hereinafter in detail with reference to the drawings and the embodiments.

DETAILED DESCRIPTION

Figure 1:
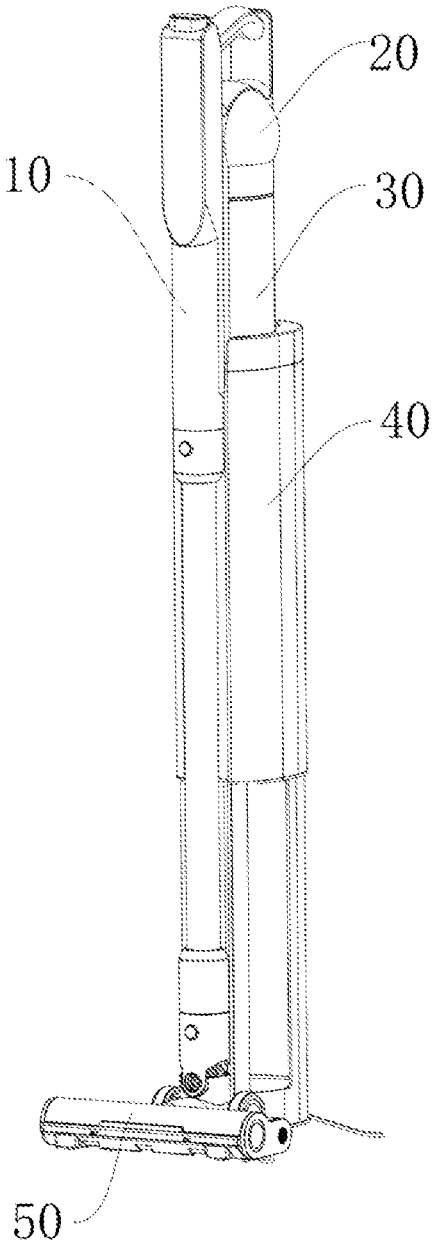
FIG. 1 is a schematic three-dimensional structure diagram of a cleaning set according to the embodiments of the present invention.

In order to make the objects, technical solutions and advantages of the present invention clearer, the present invention will be described in further detail below with reference to specific embodiments and drawings. It should be understood that these descriptions are only exemplary and are not intended to limit the scope of the present invention. In addition, in the following description, descriptions of well-known structures and technologies are omitted to avoid unnecessarily confusing the concept of the present invention.

Referring to FIG. 2 to FIG. 8, a filter assembly according to the embodiments of the present invention comprises a cyclone separator 321 and an HEPA assembly 322, wherein the HEPA assembly 322 is arranged inside the cyclone separator 321 and used as a filter element, the cyclone separator 321 is used for primary filtration and the HEPA assembly 322 is used for secondary filtration. The cyclone separator 321 comprises a filter support 3211 and a filter screen 3212 arranged on the filter support 3211, an air guide structure 32111 which protrudes outwards in a radial direction and spirally extends towards one side of the filter screen 3212 is formed on a side wall of one end of the filter support 3211, and a plurality of through first air outlet holes 32112 are formed in the air guide structure 32111. The HEPA assembly 322 comprises an HEPA support and an HEPA body 3222, the HEPA support is suitable for being fixed at one end of the filter support 3211 provided with the first air outlet holes 32112 and a plurality of second air outlet holes 32211 are formed in the HEPA support, the HEPA body 3222 is arranged on the HEPA support and comprises a plurality of folds 32221, and an airflow circulation channel 32222 in an axis direction of the cyclone separator 321 is formed between any two adjacent folds 32221. It should be noted that a top of the HEPA body is provided with an opening, so that the airflow can be discharged from the dust cup assembly through the opening in a dust suction state. The filter assembly 32 has a dust suction state and a dust blowing state when being used in a vacuum cleaner. In the dust suction state, the other end of the filter support 3211 is closed, and an airflow forms a spiral airflow along an outer contour of the air guide structure, enters the filter support 3211 after primary filtration through the filter screen 3212, and is discharged from the top opening of the HEPA body along the airflow circulation channel 32222 after secondary filtration by the HEPA assembly 322. That is to say, in the dust suction state, the airflow does not pass through the second air outlet holes 32211 when the airflow is discharged. In the dust blowing state, the airflow enters the filter support 3211 from the second air outlet holes 32211 and partly blows into a space between an outer wall of the filter screen 3212 and an inner wall of a dust cup body 31 of the vacuum cleaner through the first air outlet holes, while partly blows into a space between an inner wall of the filter support 3211 and an outer wall of the HEPA body 3222, thus realizing self-cleaning of the cyclone separator 321, the HEPA assembly 322 and the dust cup. According to the filter assembly of the embodiments of the present invention, by arranging the spiral air guide structure 32111 and forming the plurality of spiral first air outlet holes 32112 in the air guide structure 32111, gas-solid separation in the dust suction state is realized, and self-cleaning of an interior and an exterior of the filter assembly 32 and the inner wall of the dust cup during self-dust collection is realized. The structure is simple, and a self-cleaning dust-discharging effect is good.

Figure 7:
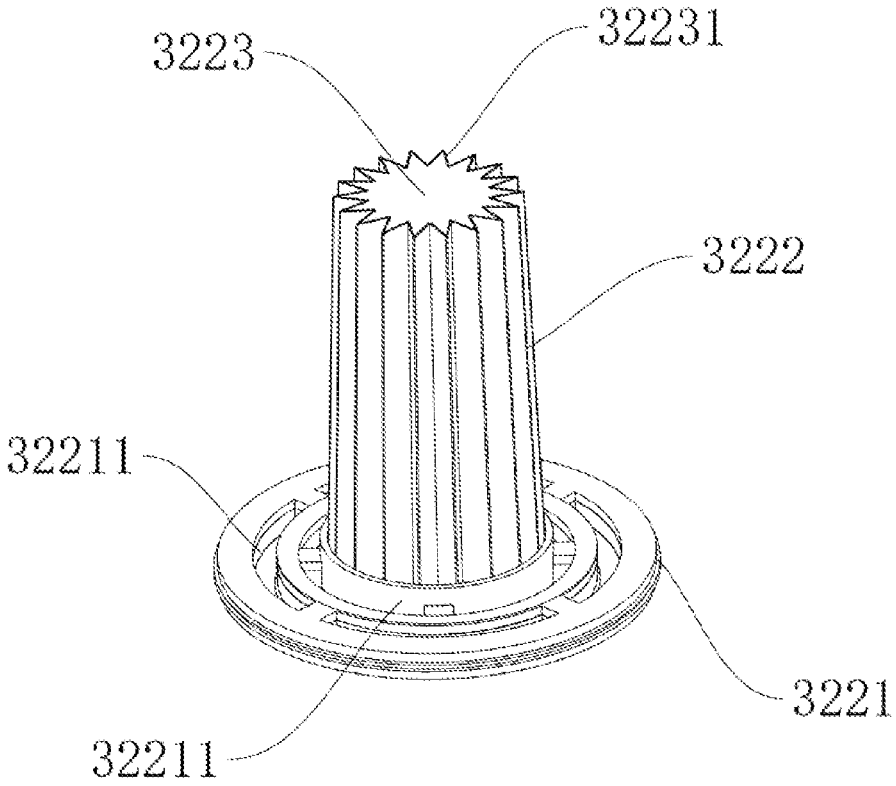
FIG. 7 is a schematic three-dimensional structure diagram of the filter assembly of FIG. 2 with a bottom of the HEPA assembly facing upwards.

It should be noted that in the embodiments of the present invention, the HEPA body 3222 is a frustum structure formed by folding a flaky or a tabular HEPA in reverse for multiple times, each fold 32221 is triangular as shown in FIG. 7, and the airflow circulation channel 32222 formed between any two adjacent folds 32221 is also triangular.

Figure 2:
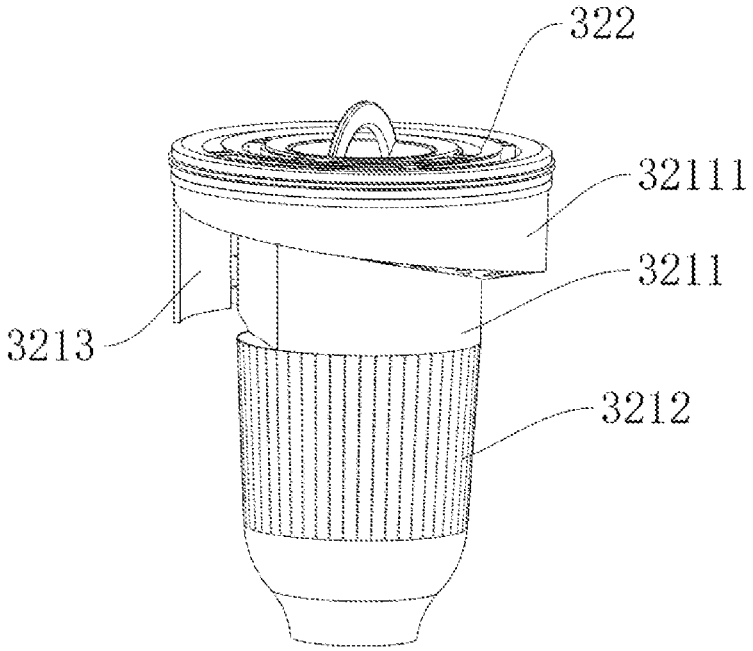
FIG. 2 is a schematic three-dimensional structure diagram of a filter assembly according to the embodiments of the present invention.
Figure 3:
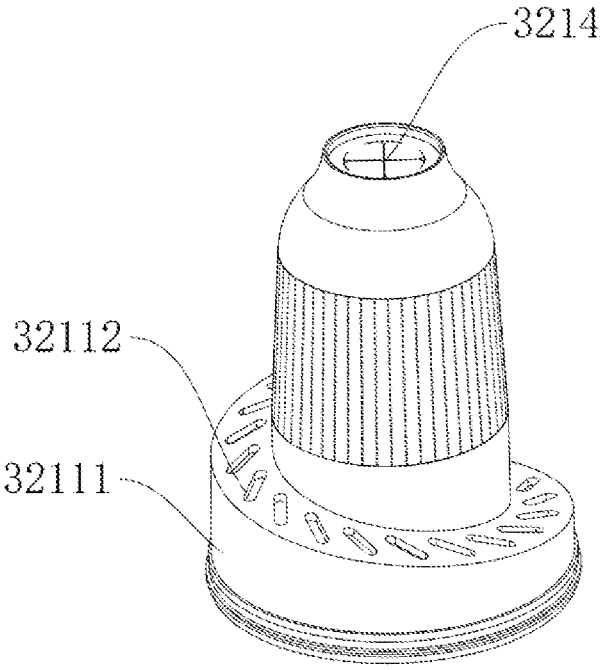
FIG. 3 is a schematic three-dimensional structure diagram of the filter assembly of FIG. 2 with a bottom of the filter assembly facing upwards.
Figure 4:
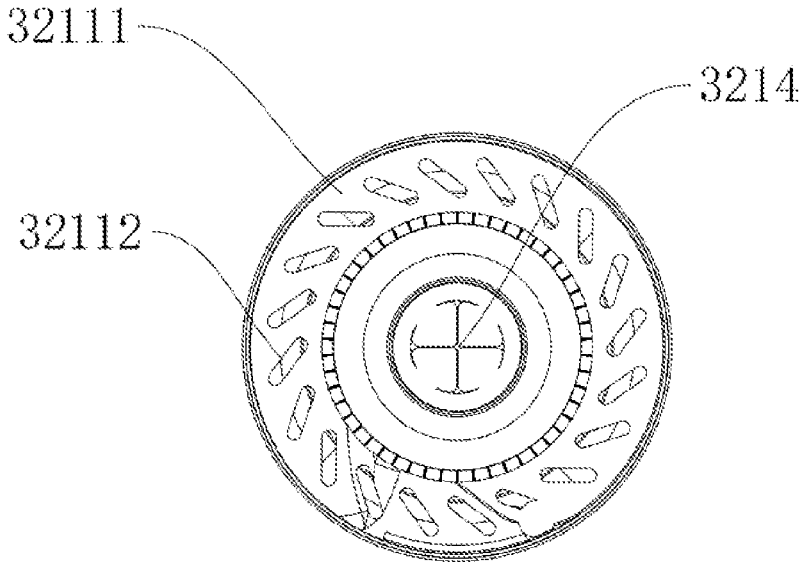
FIG. 4 is a top view of the filter assembly of FIG. 2.
Figure 5:
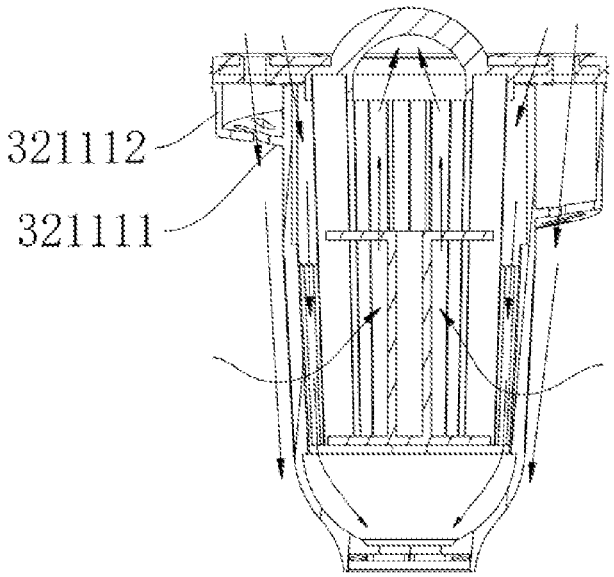
FIG. 5 is a schematic cross-sectional view of the filter assembly of FIG. 2 (arrows indicate directions of an airflow in a dust suction state and a dust blowing state)
Figure 6:
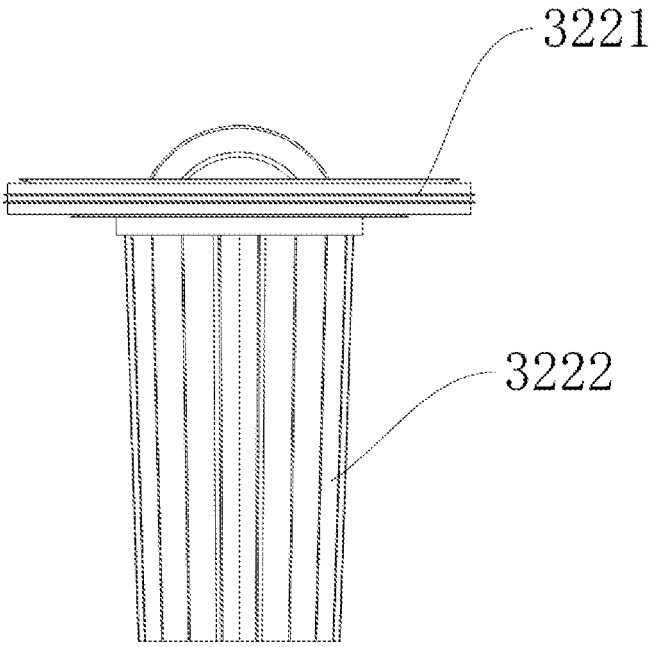
FIG. 6 is a front view of an HEPA assembly of the filter assembly of FIG. 2.
Figure 8:
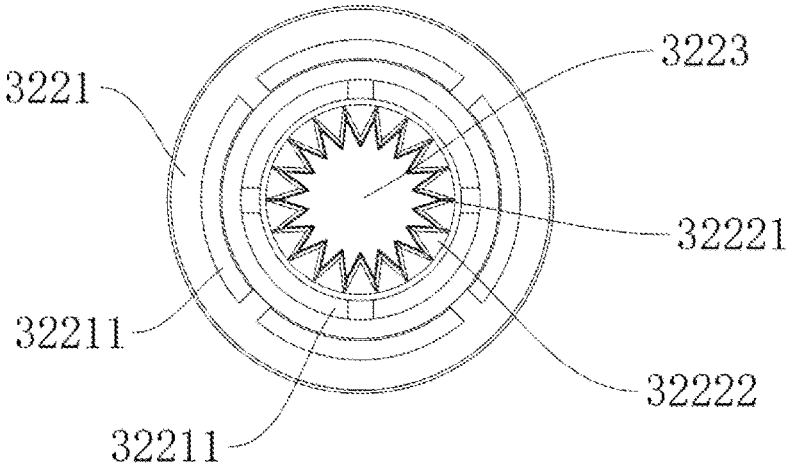
FIG. 8 is a top view of the HEPA assembly of the filter assembly of FIG. 2.
Figure 9:
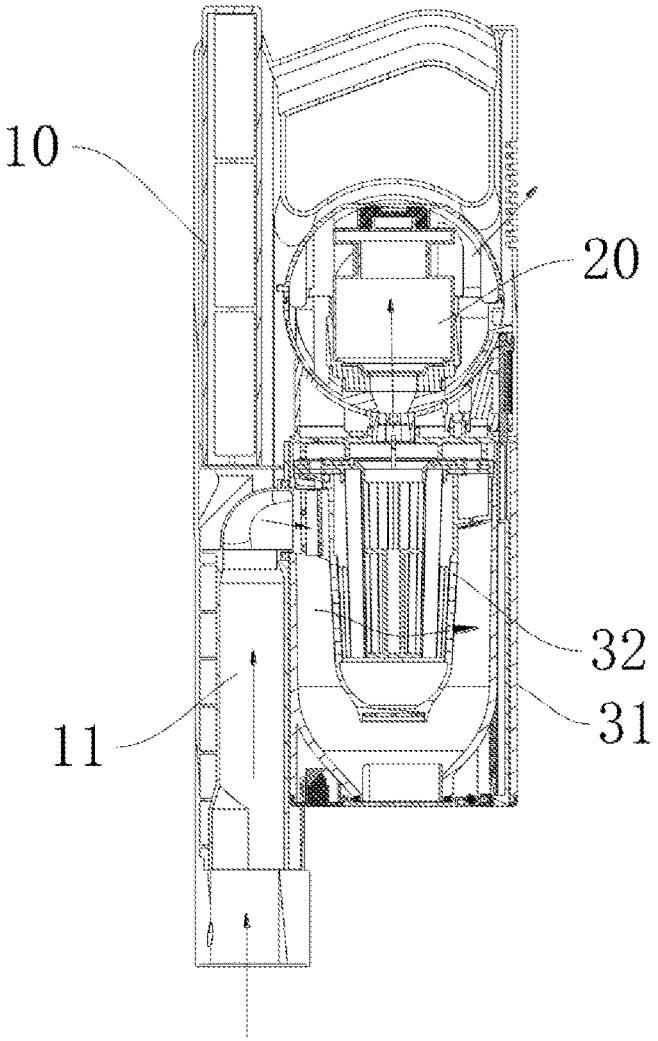
FIG. 9 is a sectional view of a vacuum cleaner according to the embodiments of the present invention.

Specifically, as shown in FIG. 2 to FIG. 8, a middle of the filter support 3211 is provided with a cavity to facilitate installation of the HEPA assembly 322. Take the use of the filter support 3211 as an example to describe and explain. As shown in FIG. 2, the filter support 3211 comprises a first section, a second section and a third section from top to bottom, wherein an outer diameter of the first section is greater than an outer diameter of the second section and an outer diameter of the third section. That is, the filter support 3211 is thicker on the top and thinner on the bottom. More specifically, an outer wall surface of the first section protrudes outwards in a radical direction to form an air guide structure spirally extending downward. In the embodiments of the present invention, the air guide structure is preferably a spiral air guide groove as shown in FIG. 3. Specifically, the air guide structure comprises a guide wall 321111 spirally extending downward from a top end of the first section as shown in FIG. 5, and an air shielding wall 321112 formed outside the guide wall 321111 and extending in an axial direction. The top end of the first section is provided with an opening to allow the HEPA module 322 to be placed and fixed. The second section is provided with a filter screen 3212, and the third section is in a shape of an inverted cone. Preferably, as shown in FIG. 3, the lower end of the third section, specifically as shown in FIG. 2, is provided with an air-blowing dust-shielding structure 3214 which is closed in the dust suction state and opened in the dust blowing state. The air guide structure, namely, the spiral air guide groove, is provided with a plurality of first air outlet holes 32112 penetrating through the guide wall 32111, and a lower end outlet of the spiral air guide groove extends to be connected with an outer side of the filter screen 3212. The filter support 3211 is also provided with an air-inlet dust-shielding structure 3213 which is opened to connect the air inlet channel and the dust cup body 31 in the dust suction state and is closed to cut off an air inlet duct 11 and the dust cup body 31 in a positive pressure dust blowing state at an air outlet position facing the air inlet channel in an installation state. Preferably, the other end of the filter support 3211, which is the lower end as shown in FIG. 2, is in an inverted cone shape, and the air-inlet dust-shielding structure 3213 is turnably arranged on a side wall at the top end of the first section of the filter support 3211, and just turns over to block an entrance of the spiral air guide groove after the air inlet channel is opened, that is, in the dust suction state, an airflow from the air inlet channel into the dust cup body 31 does not enter an interior of the spiral air guide groove, but only forms a spiral airflow downward along an outer wall of the spiral air guide groove. As for the HEPA assembly 322, as shown in FIG. 6 to FIG. 8, the HEPA assembly 322 comprises an HEPA support 3221, an HEPA body 3222 and an HEPA bottom cover 3223. The HEPA support 3221 is provided with a plurality of second air outlet holes 32211. During installation, the HEPA support 3221 is covered at the top opening of the first section of the filter support 3211, and the first air outlet holes 32112 are corresponding to the second air outlet holes 32211. The correspondence here means that projections of the first air outlet holes 32112 and the second air outlet holes 32211 on the same horizontal plane, that is, along the axial direction of the filter assembly 32 are at least partially overlapped, either completely or partially. In the preferred embodiments of the present invention, as shown in FIG. 7 and FIG. 8, the HEPA support 3221 is a circular disk frame, a wall surface of the HEPA support 3221 provided with the second air outlet holes 32211 is a circular plane, and the second air outlet holes 32211 comprise two circles of air outlet holes with a center of the circular plane as a circle center and distributed at intervals in the radial direction. To be specific, as shown in FIG. 8, two groups of second air outlet holes 32211 are provided on the HEPA support 3221. The two groups of second air outlet holes 32211 are homocentric and have different radii, that is, the HEPA support 3221 is provided with two circles (inner and outer) of second air outlet holes 32211, and each circle of second air outlet holes 32211 is preferably composed of a plurality of circumferentially spaced arcuate air holes. The second air outlet holes 32211 of the inner ring correspond to a gap between the outer wall of the HEPA body 3222 and the inner wall of the filter support 3211, that is, the second air outlet holes 32211 of the inner ring are overlapped with a projection of a space between an inner wall of the cyclone separator 321 and the outer wall of the HEPA body 3222 on a horizontal plane. The second air outlet holes 32211 of the outer ring are corresponding to the first air outlet holes 32112, that is, the second air outlet holes 32211 of the outer ring are overlapped with projections of the first air outlet holes 32112 on the horizontal plane.

According to some preferred embodiments of the present invention, the HEPA assembly 322 further comprises an HEPA bottom cover 3223 arranged at one end of the HEPA body 3222 far away from the HEPA support 3221, and the HEPA bottom cover 3223 is provided with an avoidance notch 32231 corresponding to any airflow circulation channel 32222. It should be noted that two sides of the avoidance notch 32231 are in the same plane with corresponding faces of the corresponding folds 32221, that is, in the dust suction state and the dust blowing state, the airflows passing through the airflow circulation channel 32222 will not be blocked, and directions of the airflows passing through the filter support 3211 in the two states are opposite. If the direction of the airflow inside the filter support 3211 is forward in the dust suction state, then the direction of the airflow inside the filter support 3211 is reversed in the dust blowing state, that is, the airflow blows the inner wall of the filter support 3211 and the outer wall of the HEPA body 3222 as well as an outer wall of the filter support 3211 and an inner wall of the dust cup body 31 in the dust blowing state in reverse. According to the cleaning device of the embodiments of the present invention, the airflow can directly enter the airflow circulation channel 32222 for secondary filtration through the avoidance notch 32231 in the dust suction state, and in the dust blowing state, which is specifically a self-cleaning mode, the airflow is blown from the airflow circulation channel 32222 to the HEPA body 3222 and then discharged through the avoidance notch 32231 via a bottom opening of the filter support 3211. Moreover, the arrangement of the avoidance notch 32231 can also ensure that no dust temporarily stays in a dead corner during a self-cleaning operation, and a self-cleaning efficiency of the filter can be greatly improved. Specifically, as shown in FIG. 6, the HEPA body 3222 is in an inverted cone shape with a thick upper end and a thin lower end, and the HEPA bottom cover 3223 is a polygon with multiple corners. In an alternative embodiment, the HEPA bottom cover 3223 of the HEPA assembly 322 is not provided with the avoidance notch 32231. In another alternative embodiment, the HEPA body 3222 may also be arranged in a conventional flaky manner, that is, one or more flaky HEPAs may be arranged at a bottom of the HEPA support 3221 at intervals side by side or in an array, and each flaky HEPA body 3222 is also provided with a plurality of folds 32221. It should be noted that the airflow circulation channels are different in the dust suction state and the dust blowing state. Specifically, as described above, in the dust suction state, the airflow circulation channel 32222 is a space defined between any adjacent folds on an inner wall of the HEPA body, that is, the side of the HEPA body 3222 facing away from the inner wall of the filter support 3211, while in the dust blowing state, the airflow circulation channel 32222 is a space defined between any two adjacent folds on the outer wall of the HEPA body 3222.

In the embodiments of the present invention, in the dust suction state, the air-inlet dust-shielding structure 3213 is opened, and the air-blowing dust-shielding structure 3214 is closed. The airflow with dust impurities absorbed in the air inlet channel enters the dust cup body 31 and is subjected to primary filtration by the filter screen 3212 along the air guide structure, and then the dust particles directly fall down. The airflow enters the interior of the filter support 3211 and is subjected to secondary filtration along the airflow circulation channel 32222, then enters a fan assembly 20 through the second air outlet holes 32211, and finally is discharged through a dust-suction outlet 12. In the positive pressure dust blowing state, the air-inlet dust-shielding structure 3213 is closed, and the air-blowing dust-shielding structure 3214 is opened. The airflow flowing in from a dust-blowing inlet 13 passes through the second air outlet holes 32211 through the fan assembly 20, and then is entirely blown into the space between the outer wall of the filter support 3211 and the inner wall of the dust cup body 31, or partially blown to the space between the inner wall of the filter support 3211 and the outer wall of the HEPA body 3222, and partially blown to the space between the outer wall of the filter support 3211 and the inner wall of the dust cup body 31, and finally enters a base station 40 through the opening at the bottom of the dust cup body 31 to realize self-dust collection and self-cleaning of the filter assembly 32 and the inner wall of the dust cup body 31. It should be noted that, in the dust blowing state, part of the airflow forms a spiral airflow around an outer wall of the air guide structure after going out through the first air outlet holes 32112, and a rotation direction of this part of airflow is consistent with that of the airflow entering the dust cup body 31 from the air inlet channel in the dust suction state, so that the self-cleaning of the outer wall of the cyclone filter and the inner wall of the dust cup body 31 can be realized. In addition, part of the airflow passing through the first air outlet hole 32112 will spiral downward along the guide wall 321111 to self-clean an inner wall of the filter screen 3212, and part of the airflow will enter between the inner wall of the filter support 3211 and the outer wall of the HEPA body 3222 through the second air outlet holes 32211, and the flow direction of this part of airflow is consistent with a broken line between two adjacent folds 32221 of the HEPA body 3222, so as to realize cleaning of the outer wall of the HEPA body 3222. According to the cleaning device of the embodiments of the present invention, through the improvement on the structure of the filter assembly 32, the cleaning device in the embodiments of the present invention makes the airflow blow the filter assembly 32 reversely as an existing suction self-cleaning cleaning device in the dust blowing state, but in the embodiments of the present invention, not only the self-cleaning of the outer wall of the cyclone filter and the outer wall of the HEPA body 3222 can be realized, but also the self-cleaning of the inner wall of the dust cup can be realized through the arrangement of the structure and the adoption of the positive pressure self-cleaning mode. Compared with the prior art in which a suction device or other negative pressure devices are arranged in the base station 40, a distance to the dust cup assembly 30 is shorter, and an air loss is smaller, an air force for self-cleaning is large, and a self-cleaning effect is naturally better.

The air-blowing dust-shielding structure 3214 is a conventional dust-proof sheet made of a soft material, such as a rubber sheet with a cross cut in the middle as shown in FIG. 4. As an alternative embodiment, the air-blowing dust-shielding structure 3214 may also be a conventional one-way valve, and the air can only flow in one direction, that is, the air cannot enter the interior of the filter support 3211 from bottom to top in the dust suction state, but in the dust blowing state, the airflow can be discharged from the interior of the filter support 3211 into the dust cup and then introduced into the base station 40. As another alternative embodiment, the air-blowing dust-shielding structure 3214 may not be provided, but a bottom end of the third section of the filter support 3211 is provided with an opening and the opening directly extends to contact with an inner surface of a movable cover plate 34 on a bottom cover plate 33 of the dust cup body 31, instead of being fixed. In the dust suction state, a bottom end of the filter support 3211 can be tightly sucked together with the movable cover plate 34 due to the negative pressure in the dust cup body 31, thus playing a scaling role. In the positive pressure dust blowing state, because the bottom end of the filter support 3211 is not fixedly connected with the movable cover plate 34, the movable cover plate 34 will be blown open under a positive pressure, so that the opening at the bottom end of the filter support 3211 will be opened, so that dust and other impurities on the outer wall of the HEPA body 3222 will be blown off and introduced into the base station 40 during the self-cleaning operation.

As for the air guide structure, as shown in FIG. 4, a projection of the air guide structure in a horizontal plane direction is a circular ring, and included angles formed between extending directions of at least a part of the first air outlet holes 32112 and a line connecting a center of the circular ring and any ends of the first air outlet holes 32112 are non-zero. In other words, the arrangement of the first air outlet holes 32112 on the air guide structure may be partially spiral or completely spiral. Specifically, any first air outlet hole 32112 is, but is not limited to, a waist-shaped hole or an oval hole as shown in FIG. 3 and FIG. 4, and an extending direction of any first air outlet hole 32112, that is, a long axis direction, is arranged at an included angle with a line connecting a center of the circular ring and any end (the end near or far away from the center of the circular ring) of the first air outlet hole 32112, that is, the extending direction of any first air outlet hole 32112 is not along a radius or diameter direction of the circular ring, but forms an included angle with the radius or diameter direction of the circular ring, and the included angle is not zero. With this design, the air blowing will form a spiral airflow during self-cleaning, which can achieve a better self-cleaning dust-discharging effect. Preferably, the included angles formed between the extending directions of all the first air outlet holes 32112 on a horizontal plane of projection and the line connecting the center of the circular ring and any ends of the first air outlet holes 32112 are equal. This design is convenient for designing and machining, and is more conducive to the formation of the spiral airflow, which further improves the self-cleaning effect.

The embodiments of the present invention also provide a vacuum cleaner, as shown in FIG. 2 to FIG. 9, comprising a brush head assembly 50, a body assembly, a fan assembly 20 and a dust cup assembly 30. The brush head assembly 50 is connected with an air inlet channel on the body assembly 10 through an extension pipe, the fan assembly 20 and the dust cup 30 assembly are mounted on the body assembly 10, and the dust cup assembly 30 comprises a dust cup body 31 and a filter assembly 32 arranged in the dust cup body 31. The filter assembly 32 is the filter assembly 32 according to any one of the embodiments above. As the filter assembly 32 of the above embodiments is adopted, the vacuum cleaner has at least the beneficial effects of the filter assembly 32 of the above embodiments, and the details are not repeated here. The brush head assembly 50 is an existing conventional roller floor-brush assembly, which is not described and limited in detail, and is not an inventive point of the present application.

The embodiments of the present invention also provide a cleaning set, as shown in FIG. 1 to FIG. 9, comprising a vacuum cleaner and a base station 40. The vacuum cleaner is the vacuum cleaner of the above embodiments. As the vacuum cleaner 32 of the above embodiments is adopted, the cleaning set has at least the beneficial effects of the vacuum cleaner of the above embodiments, and the details are not repeated here.

According to some preferred embodiments of the present invention, a power source of the cleaning set in a dust collection state and a power source of the cleaning set in a dust suction state are both the fan assembly 20 in the vacuum cleaner, and the fan assembly 20 blows forward to the dust cup assembly 30 and the base station 40 in the dust collection state, which is opposite to an air direction in the dust collection state when the vacuum cleaner is used alone. The specific structure and principle are not described and limited in detail here, but can refer to the description in the application document of "Cleaning Device with Dust Suction, Self-cleaning and Dust Collection" submitted by the applicant on the same day.

It should be understood that the above-mentioned specific embodiments of the present invention are only used to illustrate or explain the principles of the present invention, and are not to be construed as limiting the present invention. Therefore, any modifications, equivalent replacements, improvements, and the like within the spirit and principle of the present invention shall fall within the scope of protection of the present invention. Furthermore, the append claims of the present invention are intended to cover all changes and modifications that fall within the scope and boundary of the appended claims, or the equivalents of such scope and boundary.

The invention claimed is:

1. A filter assembly, comprising a cyclone separator for primary filtration and a high efficiency particulate air filter (HEPA) assembly for secondary filtration arranged in the cyclone separator; wherein, the cyclone separator comprises a filter support and a filter screen arranged on the filter support, an air guide structure is formed on a side wall of a first end of the filter support, wherein the air guide structure protrudes outwards in a radial direction and spirally extends towards one side of the filter screen, and first air outlet holes are formed in the air guide structure;

the HEPA assembly comprises a HEPA support and a HEPA body, the HEPA support is fixed at the first end of the filter support provided with the first air outlet holes and second air outlet holes are formed in the HEPA support, the HEPA body is arranged on the HEPA support and comprises folds, and an airflow circulation channel in an axis direction of the cyclone separator is formed between any two adjacent folds; and the filter assembly has a dust suction state and a dust blowing state when being used in a vacuum cleaner, in the dust suction state, a second end of the filter support is closed, and an airflow forms a spiral airflow along an outer contour of the air guide structure, enters the filter support after primary filtration through the filter screen, and is discharged from a top opening of the HEPA body along the airflow circulation channel after the secondary filtration by the HEPA assembly; and in the dust blowing state, the airflow enters the filter support from the second air outlet holes, a part of the airflow blows into a space between an outer wall of the filter screen and an inner wall of a dust cup body of the vacuum cleaner through the first air outlet holes, the rest of the airflow blows into a space between an inner wall of the filter support and an outer wall of the HEPA body, thus realizing self-cleaning of the cyclone separator, the HEPA assembly and a dust cup.

2. The filter assembly according to claim 1, wherein a projection of the air guide structure on a horizontal plane of projection is a circular ring, and includes angles formed between extending directions of at least a part of the first air outlet holes and a line connecting a center of the circular ring and any ends of the first air outlet holes are non-zero.

3. The filter assembly according to claim 2, wherein the included angles formed between the extending directions of all the first air outlet holes on the horizontal plane and the line connecting the center of the circular ring and any ends of the first air outlet holes are equal.

4. The filter assembly according to claim 1, wherein a wall surface of the HEPA support provided with the second air outlet holes is a circular plane, and the second air outlet holes comprise two circles of air outlet holes with a center of the circular plane as a circle center and distributed at intervals in the radial direction, the second air outlet holes of an inner ring are overlapped with a projection of a space between an inner wall of the cyclone separator and the outer wall of the HEPA body on a horizontal plane, and the second air outlet holes of an outer ring are overlapped with projections of the first air outlet holes on the horizontal plane.

5. The filter assembly according to claim 1, wherein the HEPA assembly further comprises a HEPA bottom cover, the HEPA bottom cover is arranged at one end of the HEPA body far away from the HEPA support, and the HEPA bottom cover is provided with an avoidance notch corresponding to the airflow circulation channel.

6. The filter assembly according to claim 1, wherein the HEPA body is columnar or flaky.

7. The filter assembly according to claim 1, wherein the second end of the filter support is in an inverted cone shape and extends to contact with a movable cover plate on a bottom cover of the dust cup of the vacuum cleaner or is internally provided with an air-blowing dust-shielding structure, wherein the air-blowing dust-shielding structure is closed in the dust suction state and opened in the dust blowing state.

8. The filter assembly according to claim 7, wherein the air-blowing dust-shielding structure is a dust-proof sheet made of a soft material or is a one-way valve.

9. A vacuum cleaner, comprising a brush head assembly, a body assembly, a fan assembly and a dust cup assembly, wherein the brush head assembly is connected with an air inlet channel on the body assembly through an extension pipe, the fan assembly and the dust cup assembly are mounted on the body assembly, the dust cup assembly comprises a dust cup body and the filter assembly according to claim 1, and the filter assembly is arranged in the dust cup body.

10. A cleaning set, comprising at least one of the vacuum cleaner according to claim 9 and a base station, wherein a power source of the base station in a dust collection state and a power source of the vacuum cleaner in the dust suction state are both the fan assembly in the vacuum cleaner, and the fan assembly blows forward to the dust cup assembly and the base station in the dust collection state.

* * * * *